United States Patent [19]

Fowler

[11] 4,191,145

[45] Mar. 4, 1980

[54] VACUUM SENSOR

[75] Inventor: Albert L. Fowler, Kirkaldy, Scotland

[73] Assignee: Hughes Microelectronics Limited, Glenrothes, Scotland

[21] Appl. No.: 907,440

[22] Filed: May 19, 1978

[30] Foreign Application Priority Data

Oct. 18, 1977 [GB] United Kingdom ..... 43380/77

[51] Int. Cl.[2] ..... F02P 5/04

[52] U.S. Cl. ..... 123/117 A; 123/117 R

[58] Field of Search ..... 123/117 A, 117 R

[56] References Cited

U.S. PATENT DOCUMENTS

| | | | |
|---|---|---|---|
| 1,288,736 | 12/1918 | Stone | 123/117 A |
| 1,466,470 | 8/1923 | Dodson | 123/117 A |
| 3,596,644 | 8/1971 | Hutchins | 123/117 A |
| 3,646,921 | 3/1972 | Marsu | 123/117 A |
| 3,815,560 | 6/1974 | Wahl et al. | 123/117 A |
| 4,054,110 | 10/1977 | Walker et al. | 123/117 A |
| 4,096,843 | 6/1978 | Marsu | 123/117 A |

FOREIGN PATENT DOCUMENTS

| | | | |
|---|---|---|---|
| 2210032 | 9/1973 | Fed. Rep. of Germany | 123/117 A |

*Primary Examiner*—Charles J. Myhre
*Assistant Examiner*—P. S. Lall
*Attorney, Agent, or Firm*—Lawrence V. Link, Jr.; W. H. MacAllister

[57] ABSTRACT

The invention concerns an internal combustion engine provided with a vacuum sensor for monitoring the level of partial vacuum in the engine's inlet manifold, in order to provide an indication of engine load. during changes in engine load, the level of partial vacuum presented to the vacuum transducer is modified from that obtaining in the inlet manifold in order to improve the accuracy of the output of the transducer during changes of engine load.

8 Claims, 2 Drawing Figures

VACUUM SENSOR

FIELD OF THE INVENTION

This invention relates to an internal combustion engine and particularly to a vacuum sensor arranged to monitor the level of partial vacuum obtaining in the inlet manifold of the engine.

BACKGROUND TO THE INVENTION

It is well known that gas to be consumed in cylinders of an internal combustion engine, is drawn therein through an inlet manifold, past a speed control throttle. The gas usually comprises a fuel/air mixture produced by a carburettor but the gas can comprise air alone if the engine includes a fuel injection system.

In operation of the engine, the throttle causes a partial vacuum to be established in the inlet manifold, the level of partial vacuum being a function of the load of the engine. More particularly, when the engine is idling under substantially no load, the throttle is almost closed and causes a reduction in the pressure of gas in the inlet manifold, but when the throttle is opened to permit the engine to work against an increased load, the gas pressure in the inlet manifold increases thereby decreasing the level of partial vacuum.

It is known to provide a vacuum transducer arranged to sense the level of partial vacuum in the inlet manifold, to provide an indication of engine load, and such a transducer has been used with engines having a spark ignition system to control the timing of the spark ignition system as a function of engine load.

When the engine is in dynamic equilibrium, the partial vacuum in the inlet manifold constitutes an accurate indication of engine load. However a major disadvantage of the known vacuum transducer arrangement is that during operation of the speed control throttle to change the engine load, the engine moves out of dynamic equilibrium which results in the inlet manifold pressure lagging behind the value it would assume under steady state engine conditions to reflect accurately the engine load. Consequently, the output of the vacuum transducer becomes delayed and inaccurate during changes in engine load.

SUMMARY OF THE INVENTION

It is an object of the present invention to provide an internal combustion engine with an improved vacuum sensor which provides an improved indication of engine load during changes in engine load.

It is another object of the invention to provide for an engine with spark ignition system, a vacuum sensor which provides for an improved control of ignition timing during changes in engine load.

These objects and others are achieved in accordance with the present invention by providing an internal combustion engine so arranged that upon operation of the throttle to cause the engine to work against a changed engine load, the level of partial vacuum presented to the vacuum transducer is modified from that obtaining in the inlet manifold in order to cause the vacuum transducer to provide an output more accurately indicative of engine load during changes of engine load.

Accordingly, the present invention provides an internal combustion engine including an inlet manifold for receiving gas to be consumed by the engine, a throttle adapted to be opened or closed selectively to control the volumetric flow rate of said gas into the inlet manifold, and a vacuum sensor for sensing the level of partial vacuum obtaining in the inlet manifold, said vacuum sensor comprising a vacuum transducer arranged to sense the level of partial vacuum obtaining in the inlet manifold, and means for modifying the level of partial vacuum sensed by the transducer from the level obtaining in the inlet manifold during opening or closing of the throttle.

The invention has particular application to an internal combustion engine which includes a spark ignition system, since the timing of the ignition can be controlled in accordance with the output of the vacuum sensor, whereby to provide an improved control of the ignition timing during changes in engine load.

In one particular form of the present invention, the gas supplied to the inlet manifold comprises a fuel/air mixture produced by a carburettor, although alternatively, the engine can include a fuel injection system for injecting fuel directly into cylinders of the engine in which case the inlet manifold is arranged to supply air alone to the cylinders.

If the engine is provided with a fuel injection system, the output of the vacuum sensor can advantageously be used in computing the desired amounts of fuel to be injected into the cylinders.

BRIEF DESCRIPTION OF THE DRAWINGS

In order that the invention may be more fully understood and readily carried into effect, preferred embodiments thereof will now be described by way of example with reference to the accompanying drawings in which.

DESCRIPTION OF PREFERRED EMBODIMENTS

Figure 1:
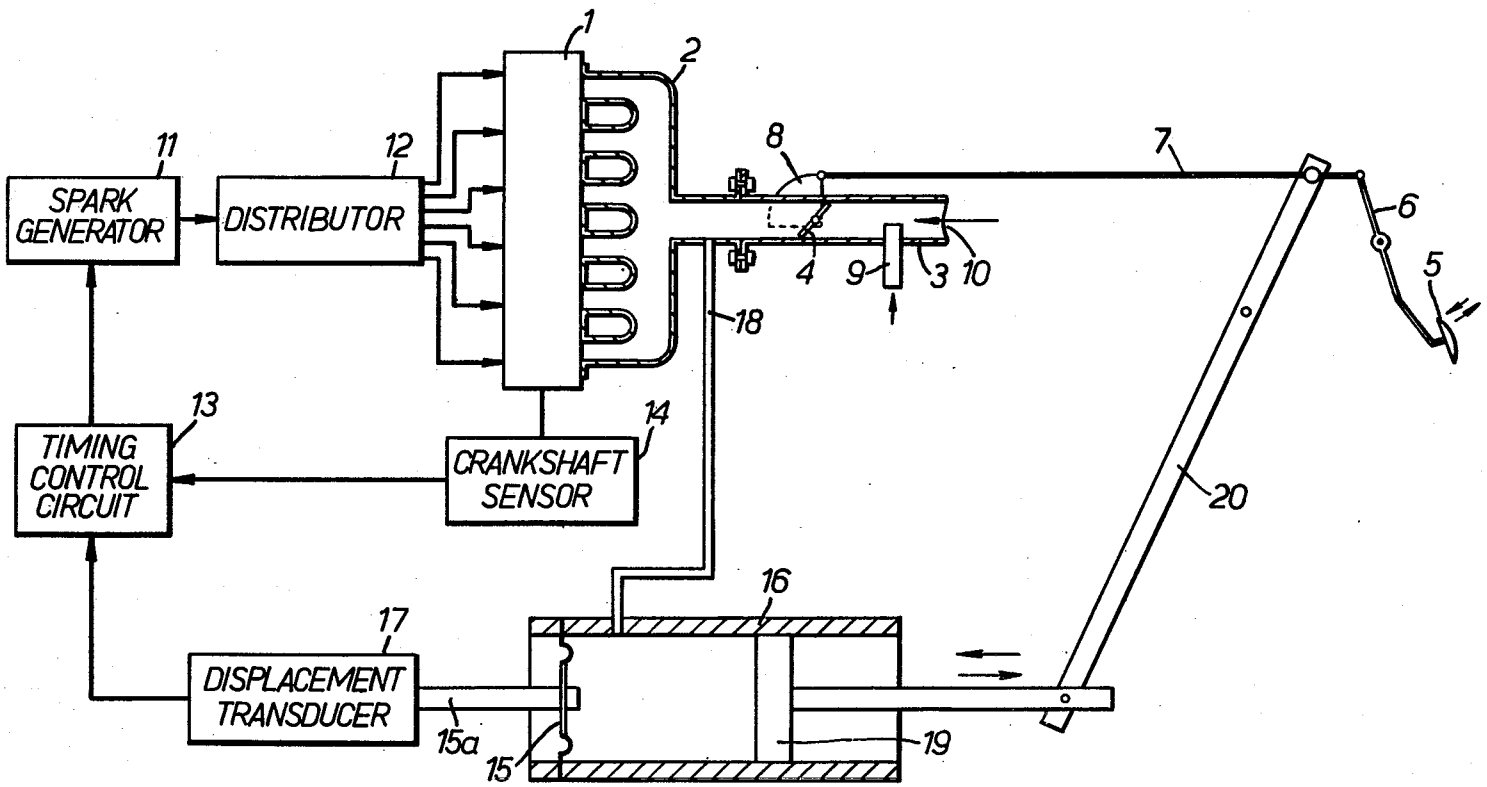
FIG. 1 is a schematic illustration of an example of an internal combustion engine in accordance with the present invention.

Referring firstly to FIG. 1, a six cylinder internal combustion engine 1 for an automobile is shown schematically having an inlet manifold 2 connected to a carburettor 3. The carburettor includes a speed control throttle comprising a butterfly valve 4 which is operated by an accelerator pedal 5 through a linkage comprising a lever 6, a rod 7 and a cam 8. Fuel is vaporised in the carburettor by means of a jet 9 upstream of the butterfly valve 4 such that the fuel is mixed intimately with air entering through an air inlet 10.

The spark plugs of the engine (not shown) are fed with sparks from a spark generator 11 via for example a conventional mechanical distributor 12. The spark generator 11 comprises a conventional ignition coil. Input pulses are fed to the spark generator 11 by a timing control circuit 13 in order to generate high voltage pulses to be applied to the spark plugs.

The circuit 13 produces pulses in response to a crankshaft sensor 14 such that a pulse is produced each time a piston moves towards its top dead centre position with its cylinder primed with fuel/air mixture.

The timing of the pulses produced by the circuit 13 is controlled by a vacuum sensor which will now be described in detail.

The arrangement includes a vacuum transducer comprising a diaphragm 15, the diaphragm being mounted at one end of a cylinder 16 and being adapted to move back or forth in response to changes of pressure in the cylinder. Movement of the diaphragm is sensed by means of a rod 15*a* mounted on the diaphragm and received in a displacement transducer 17 that produces an electrical signal indicative of displacement of the rod. The displacement transducer is typically but not exclusively of the kind described in British Pat. No. 1,481,166. The electrical signal produced by the transducer 17 is applied to the circuit 13 to control the advance or retardation of the pulses applied to the spark generator 11.

The cylinder 16 is connected to the inlet manifold 2 by means of a conduit 18 which is of a small cross section such that it takes for example several seconds for the pressure obtaining in the inlet manifold to become established in the cylinder. Slidably mounted in the cylinder 16 is a piston 19 connected to the accelerator pedal linkage by a lever 20.

When the engine is running at a constant speed, the butterfly valve 4 is opened by an amount determined by operation of the accelerator pedal 5, and a partial vacuum obtains in the inlet manifold and substantially the same level of vacuum pertains in the cylinder 16, causing a commensurate deformation of the diaphragm 15 and thereby causes the displacement transducer 17 to supply to the timing control circuit 13 an electrical signal to control the timing of the ignition in dependence upon the inlet manifold vacuum level.

Upon acceleration of the engine to cause the engine to work against an increased engine load, the accelerator pedal 5 is depressed to open further the butterfly valve 4 and the vacuum level in the inlet manifold 2 starts to decrease towards a new value as the engine accelerates to assume an increased rate of working. However, during the acceleration, the vacuum level in the inlet manifold 2 lags behind the vacuum level that would reflect the load under steady state engine conditions and thus does not constitute an accurate parameter for controlling ignition timing during the acceleration. This problem is overcome by means of the piston 19. Operation of the accelerator pedal 5 to effect the acceleration causes the piston 19 to move into the cylinder 16 by a distance dependent upon the depression of the accelerator, the distance being so arranged that the partial vacuum sensed by the diaphragm 15 is instantaneously decreased to a level which for example is an anticipation of the steady state vacuum level that will occur in the inlet manifold when the acceleration has been completed. As a result, the timing of the ignition is more accurately controlled during the acceleration than if the inlet manifold pressure were alone utilised to control the ignition timing. The cross sectional area of the tube 18 is selected so that the pressure in the cylinder 16 is effectively decoupled from the pressure in the inlet manifold 2 during a major part of the acceleration, but towards the end of the acceleration, the pressure in the inlet manifold and that in the cylinder will move into equality so that as the engine reaches a dynamic equilibrium, the vacuum level in the manifold 2 again dictates the timing of the ignition.

Clearly, the apparatus will work in an inverse manner during deceleration of the engine.

Figure 2:
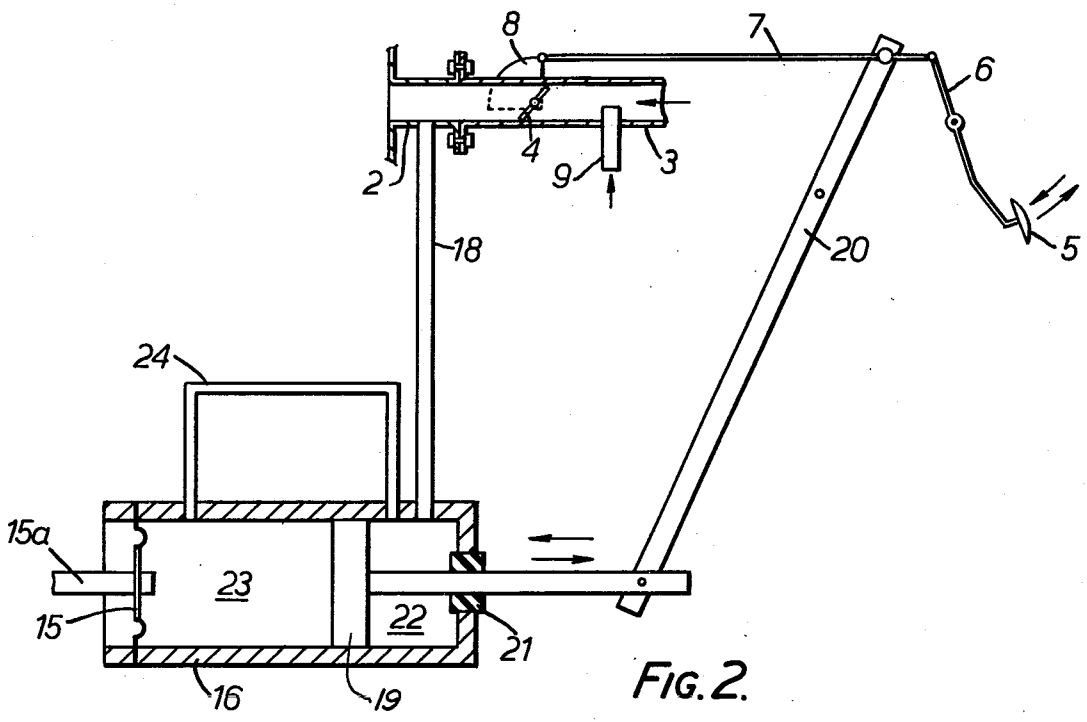
FIG. 2 illustrates a modification to the engine of FIG. 1.

A modification of the apparatus of FIG. 1 will now be described with reference to FIG. 2. Like parts in the two Figures are marked with the same reference numerals and the details of the engine, the spark generating and timing control circuits have been omitted from FIG. 2 for purposes of clarity. In the arrangement of FIG. 2, the cylinder 16 is closed on to the rod of the piston by a seal 21, the piston thus defining two chambers 22, 23 of variable volume within the cylinder. The chamber 22 is connected to the inlet manifold by a conduit 18 which is of a large diameter so that the pressure in the chamber 22 substantially instantaneously follows the inlet manifold pressure. The chambers 22, 23 are interconnected by a passageway comprising a conduit 24 which performs the same function as the conduit 18 of FIG. 1.

Thus, in use of the arrangement of FIG. 2, when the accelerator pedal 5 is depressed to accelerate the engine, the piston 19 is moved to decrease the volume of chamber 23 and increase the volume of chamber 22. As a result, the pressure in chamber 23 is increased which operates the diaphragm 15, the rod 15*a* and the transducer 17 (not shown in FIG. 2), to retard the ignition timing. The pressure increases in chamber 22 as acceleration of the engine proceeds, and the pressure difference between the chambers equalises slowly through the conduit 24 as the acceleration proceeds. Thus, initially, the pressure in chamber 23 is increased by depression of the accelerator pedal 5 to retard the ignition timing, the pressure increase being decoupled from the inlet manifold pressure. However, as the acceleration proceeds, the pressure in chamber 23 equalises with that in the inlet manifold 2, so that in dynamic equilibrium of the engine, the pressure in the inlet manifold dictates the ignition timing advance.

The arrangement of FIG. 2 has the advantage over the FIG. 1 arrangement that in steady state conditions, no differential vacuum pressure acts on the piston 19 and thus there is no tendency for the piston to be pulled into the cylinder 16. Should the apparatus cause an undesirable increase in accelerator pedal load, a servo mechanism can be provided although such a servo is not thought to be necessary in practice. Furthermore, whilst the described examples of the invention include an electronic ignition system, the vacuum diaphragm 15 could also be connected to operate for example electronic fuel systems or a conventional mechanical advance and retard arrangement.

Various other modifications are possible. For example, the piston can be made to move as a non linear function of the angle of movement of the accelerator pedal 5 so as to meet specific non linear throttle angle/pressure law requirements of the engine. The foregoing modification is useful for example in improving said driveability, economy, avoidance of detonation areas in the ignition advance map. Moreover the conduit 24 could be replaced by a two way ball valve connected to the chamber 22 and 23, in order to decouple chamber 23 from chamber 22 during changes of acceleration.

Also, whilst the invention has been described hereinbefore by way of example with reference to an engine including a carburettor, the invention also includes within its scope an internal combustion engine that is provided with a fuel injection system. With engines provided with fuel injection systems, the fuel is injected directly into the engine's cylinders and the inlet manifold supplies air to the cylinders, a combustible fuel/air mixture being formed directly in the cylinders rather than by use of a carburettor. In order to optimise combustion and obtain a correct ratio of fuel to air in the mixture formed in the cylinders, it is necessary to control accurately the amount of fuel injected into the cylinders in dependence upon operating parameters of the engine and particularly the load of the engine. Accordingly an internal combustion engine in accordance with the present invention can provide by means of its vacuum sensor a signal accurately indicative of the load of the engine both during dynamic equilibrium of the engine and during changes in engine load, which signal can be used in computing desired amounts of fuel to be injected into the engine's cylinders. As is well known, an internal combustion engine including a fuel injection does not necessarily have a spark ignition system, and the present invention includes within its scope engines with fuel injection systems which include and do not include spark ignition systems.

I claim:

1. A vacuum sensor for use with an internal combustion engine having an inlet manifold for receiving gas to be consumed by said engine, and a throttle adapted to be selectively positioned so as to control the volumetric flow rate of said gas into said inlet manifold, said vacuum sensor comprising:

a vacuum transducer for sensing the level of partial vacuum applied thereto; and means for applying the level of partial vacuum present in said inlet manifold to said vacuum transducer after the operation of said engine reaches dynamic equilibrium and for modifying, during a change in throttle position, the level of partial vacuum applied to said transducer so that before the partial vacuum level present in said inlet manifold changes to a new value associated with the equilibrium condition of operation for the new throttle position, said modified partial vacuum level approximates said new value.

2. A vacuum sensor in accordance with claim 1, wherein said means for applying and modifying includes a piston and cylinder assembly, said cylinder being connected to said inlet manifold to receive the level of partial vacuum present therein, said vacuum transducer being arranged to provide an output indicative of the level of vacuum present in said cylinder, and said piston being connected so as to be moved along said cylinder in dependence upon the movement of said throttle.

3. A vacuum sensor in accordance with claim 2, wherein said piston is connected to said throttle by a mechanical linkage.

4. A vacuum sensor in accordance with claim 2, wherein said transducer includes a diaphragm mounted at one end of said cylinder.

5. A vacuum sensor in accordance with claim 2, 3 or 4 wherein said cylinder defines chambers on opposite sides of said piston, one of said chambers being connected to receive gas therein at the pressure present in said inlet manifold and the other chamber including said transducer, and including a restricted gas flow passageway between said chambers, whereby upon movement of said piston the pressure in said one chamber changes relative to the pressure in said other chamber and subsequently said pressures equalize.

6. A vacuum sensor in accordance with claim 5, wherein said passageway includes a flow restrictor valve.

7. A vacuum sensor for use with an internal combustion engine having an inlet manifold for receiving gas to be consumed by said engine and a throttle adapted to be selectively positioned so as to control the volumetric flow rate of said gas into the inlet manifold, said vacuum sensor comprising:

a piston and cylinder assembly, said piston being connected so as to be moved along said cylinder in dependence upon the movement of said throttle;

a restricted gas flow passageway for connecting said cylinder and said inlet manifold; and a vacuum transducer for providing an output signal indicative of the level of partial vacuum present in said cylinder; whereby upon movement of said piston, the pressure in said cylinder changes relative to the pressure in said inlet manifold and subsequently said pressures equalize.

8. A vacuum sensor for use with an internal combustion engine having an inlet manifold for receiving gas to be consumed by said engine and a throttle adapted to be selectively positioned so as to control the volumetric flow rate of said gas into the inlet manifold, said vacuum sensor comprising:

a vacuum transducer for sensing the level of partial vacuum applied thereto;

a piston and cylinder assembly, said piston being connected so as to be moved along said cylinder in dependence upon the movement of said throttle, and wherein said cylinder defines chambers on opposite sides of said piston, one of said chambers being connected to have substantially the same partial vacuum level as is present in said inlet manifold and the other chamber including said transducer; and a restricted gas flow passageway between said chambers;

whereby upon movement of said piston, the pressure in said one chamber changes relative to the pressure in said other chamber and subsequently said pressure equalize.

* * * * *